US007767274B2

(12) United States Patent
Skaff

(10) Patent No.: US 7,767,274 B2
(45) Date of Patent: Aug. 3, 2010

(54) PLASMA BORIDING METHOD

(75) Inventor: Habib Skaff, Tampa, FL (US)

(73) Assignee: Skaff Corporation of America, Tampa, FL (US)

( * ) Notice: Subject to any disclaimer, the term of this patent is extended or adjusted under 35 U.S.C. 154(b) by 696 days.

(21) Appl. No.: 11/534,086

(22) Filed: Sep. 21, 2006

(65) Prior Publication Data

US 2007/0098917 A1 May 3, 2007

Related U.S. Application Data

(60) Provisional application No. 60/720,251, filed on Sep. 22, 2005.

(51) Int. Cl.
*H05H 1/24* (2006.01)

(52) U.S. Cl. ..... 427/569; 427/573; 427/576; 427/590

(58) Field of Classification Search ..... 427/569, 427/573, 576, 590
See application file for complete search history.

(56) References Cited

U.S. PATENT DOCUMENTS

| | | | | |
|---|---|---|---|---|
| 2,025,060 | A | 12/1935 | Kormann et al. | |
| 2,046,914 | A | 7/1936 | Kormann et al. | |
| 3,164,215 | A | 1/1965 | Johnson | |
| 3,793,160 | A | 2/1974 | Homan | |
| 3,926,327 | A | 12/1975 | Schickdanz | |
| 4,016,013 | A | 4/1977 | Bitzer et al. | |
| 4,533,004 | A | 8/1985 | Ecer | |
| 4,610,437 | A | 9/1986 | Baudis et al. | |
| 4,637,837 | A | 1/1987 | Von Matushka et al. | |
| 4,725,508 | A | 2/1988 | Rangaswamy et al. | |
| 4,746,554 | A | 5/1988 | Ecer | |
| 4,851,255 | A * | 7/1989 | Lagendijk et al. | 427/529 |
| 5,009,000 | A | 4/1991 | Wilmeth et al. | |
| 5,328,763 | A | 7/1994 | Terry | |
| 5,861,630 | A | 1/1999 | Becker | |
| 6,011,248 | A | 1/2000 | Dennis | |
| 6,230,610 | B1 | 5/2001 | Pippert | |
| 6,245,162 | B1 | 6/2001 | Baudis et al. | |
| 6,306,225 | B1 | 10/2001 | Hunger et al. | |
| 6,463,843 | B2 | 10/2002 | Pippert | |
| 6,617,057 | B2 | 9/2003 | Gorokhovsky et al. | |
| 6,723,279 | B1 | 4/2004 | Withers et al. | |
| 6,783,794 | B1 * | 8/2004 | Cabeo et al. | 427/8 |
| 6,830,441 | B1 | 12/2004 | Williams | |
| 6,855,081 | B2 | 2/2005 | Koschig | |
| 6,878,434 | B2 | 4/2005 | Kujioka et al. | |
| 7,139,219 | B2 | 11/2006 | Kolle et al. | |
| 2002/0189716 | A1 | 12/2002 | Savich | |
| 2005/0139236 | A1 | 6/2005 | Kool et al. | |
| 2005/0163647 | A1 | 7/2005 | Donahue et al. | |
| 2005/0178558 | A1 | 8/2005 | Kolle et al. | |
| 2005/0208213 | A1 | 9/2005 | Chandran et al. | |
| 2005/0208218 | A1 | 9/2005 | Becker et al. | |
| 2005/0287307 | A1 * | 12/2005 | Singh et al. | 427/523 |
| 2006/0165973 | A1 | 7/2006 | Dumm et al. | |
| 2008/0029305 | A1 | 2/2008 | Skaff | |
| 2008/0233428 | A1 | 9/2008 | Skaff | |

OTHER PUBLICATIONS

Brandstotter, et. al.: "Multiphase reaction to diffusion in transition metal-boron systems" Journal of Alloys and Compounds, 262-263 (1997), 390-396.

Gardner Denver Inc., Gardner Denver Service Manual.

Hunger, et. al.: "Generation of boride layers on steel and nickel alloys by plasma activation of boron trifluoride" Thin Solid Films 310 (1997) 244-250.

Iakovou, et. al.: "Synthesis of boride coats on steel using plasma transferred arc (PTA) process and its wear performance" Wear 252 (2002) 1007-1015.

Kashaev, et. al.: "Plasma-assisted boronizing using triethyl borane" Harterei-Technishce Mitteilungen vol. 58, No. 5 pp. 243-250 (English Translation of the Abstract Only).

Knotek, et. al.: "Surface layers on cobalt base alloys by boron diffusion", paper presented at the International Conference on Metallurgical Coatings, San Francisco, CA, Mar. 28-Apr. 1, 1977.

Kuper, et. al.: "A novel approach to gas boronizing" Surface and Coatings Technology 130 (2000) 87-94.

Kwok, et. al.: "Profile control in BF3 plasma doping" Journal of Applied Physics, vol. 88, No. 6, 2000, pp. 3198-3200.

Nam, et. al.: "A study on plasma-assisted boriding of steels" Surface and Coatings Technology 98 (886-890).

Piekoszewski, et. al.: "Modification of the surface properties of materials by pulsed plasma beams" Surface and Coatings Technology 106 (1998) 228-233.

Ruset, et. al.: "Plasma Boriding with Boron Trifluoride Gas" Heat Treatment of Metals vol. 4, No. 4, pp. 91-96.

Sugai, et. al.: "Plasma-assisted surface modification and radical diagnostics" Journal of Nuclear Materials 200 (199H.

(Continued)

*Primary Examiner*—Binh X Tran
(74) *Attorney, Agent, or Firm*—Choate Hall & Stewart LLP; Andrea L. C. Robidoux

(57) ABSTRACT

The present invention relates to a method of preparing wear-resistant metallic surfaces.

15 Claims, No Drawings

OTHER PUBLICATIONS

Yu, et. al.: "Bonding of mild steel using the spark plasma sintering (SPS) technique" Surface and Coatings Technology 157 (2002) 226-230.
Search Report for International Application No. PCT/US07/009606.
Search Report for International Application No. PCT/US08/057832.
Choy, "Chemical vapour deposition of coatings" Progress in Materials Science 48 (2003) p. 57-170.
Sun, Y. of Alloys and Compounds 231 (1995) p. 380-86.
Search Report for International Application No. PCT/US06/036791.
Written Opinion for International Application No. PCT/US06/036791.
Written Opinion for International Application No. PCT/US07/009606.
Written Opinion for International Application No. PCT/US08/057832.
Search results from Sep. 29, 2005.
International Preliminary Report on Patentability for International Patent Application No. PCT/US07/009606.

* cited by examiner

PLASMA BORIDING METHOD

CROSS-REFERENCE TO RELATED APPLICATIONS

The present application claims priority to U.S. provisional patent application No. 60/720,251, filed Sep. 22, 2005, the entirety of which is hereby incorporated herein by reference.

FIELD OF THE INVENTION

The present invention relates to a method of preparing wear-resistant metallic surfaces.

BACKGROUND OF THE INVENTION

Boriding is known to increase wear-resistance in metallic surfaces. Various methods of boronizing metallic surfaces are known. Such methods produce a boron layer on a metal surface. Typically, these methods utilize reactive boron species which diffuse into the metal surface. Such reactive boron species include gaseous diborane and boron trihalides, including $BCl_3$ and $BF_3$.

One method for boriding metallic surfaces is the "pack" method. In this methods, the boron source is in the form of a solid powder, paste, or in granules. The metal surface is packed with the solid boron source and then heated to release and transfer the boron species into the metal surface. This method has many disadvantages including the need for using a large excess of the boron source resulting in the disposal of excessive toxic waste.

Another method for boriding metallic surfaces utilizes a plasma charge to assist in the transfer of boron to the metal surface. Typically, plasma boronization methods utilize diborane, $BCl_3$, or $BF_3$ where the plasma charge is applied to the gaseous boron-containing reagent to release reactive boron species. See U.S. Pat. No. 6,306,225 and U.S. Pat. No. 6,783,794, for example. However, these methods utilize corrosive and highly toxic gases and are thus difficult to utilize on an industrial scale.

Plasma boriding processes have several advantages, including speed and localized heating of the substrate. This prevents the bulk metal in the borided piece from annealing, obviating additional heat treatments to restore the original microstructure and crystal structure. As a result, it is desirable to have plasma boriding processes that retain the advantages of plasma treatment while reducing the hazards and costs connected with noxious chemicals.

DETAILED DESCRIPTION OF CERTAIN EMBODIMENTS

The present invention provides a method for boriding a metal surface. According to methods of the present invention, $KBX_4$, wherein X is a halogen, is provided as a boron source. Use of $KBX_4$ is advantageous in that it is a solid substance which is readily available and easily handled. In certain embodiments, $KBX_4$ is provided in solid form in the presence of a metal surface to be borided. Heat is applied such that the $KBX_4$ releases $BX_3$ gas to which a plasma charge is applied. Without wishing to be bound by any particular theory, it is believed that the plasma charge results in the formation of one or more active boron species which diffuse into the metal surface. As used herein, the term "activated boron species" refers to any one or more of the boron species created from applying the plasma charge to the gas resulting from heating $KBX_4$. In certain embodiments, the one or more activated boron species include, but are not limited to, $B^+$, $BX^+$, $BX_2^+$, and $BX_3^+$.

As used herein, the terms "boriding" and "boronizing" are used interchangeably and refer to the process of incorporating a boron layer on a metal surface.

As used herein, the term "plasma" refer to an ionized gas and the term "plasma charge" refers to an electric current applied to a gas to form a plasma. In certain embodiments, a plasma of the present invention comprises one or more activated boron species including, but not limited to, $B^+$, $BX^+$, $BX_2^+$, and $BX_3^+$, wherein each X is a halogen.

As used herein, the term "glow discharge" refers to a type of plasma formed by passing a current at 100 V to several kV through a gas. In some embodiments, the gas is argon or another noble gas.

In certain embodiments, each X is chlorine and the $KBX_4$ is $KBCl_4$.

In other embodiments, each X is fluorine and the $KBX_4$ is $KBF_4$.

In certain embodiments, the present invention provides a method for boriding a metal surface, comprising the steps of:

(a) providing $KBX_4$, wherein each X is halogen;

(b) heating the $KBX_4$ at a temperature sufficient to release $BX_3$; and (c) applying a plasma charge to the $BX_3$ to create one or more activated boron species for diffusing into the metal surface.

In other embodiments, the present invention provides a method for boriding a metal surface, comprising the steps of:

(a) providing $KBX_4$, wherein each X is halogen, in the presence of the metal surface;

(b) heating the $KBX_4$ at a temperature sufficient to release $BX_3$; and (c) applying a plasma charge to the $BX_3$ to create one or more activated boron species for diffusing into the metal surface.

In certain embodiments, the metal surface to be boronized is an iron-containing metal. Iron-containing metals are well known to one of ordinary skill in the art and include steels, high iron chromes, and titanium alloys. In certain embodiments, the iron-containing metal is a stainless steel or 4140 steel. In other embodiments, the stainless steel is selected from 304, 316, 316L steel. According to one embodiment, the iron-containing metal is a steel selected from 301, 301L, A710, 1080, or 8620. In other embodiments, the metal surface to be boronized is titanium or a titanium-containing metal. Such titanium-containing metals include titanium alloys.

In other embodiments, the $KBX_4$ is provided in solid form in a chamber containing the metal surface to be borided. The $KBX_4$ is heated to release $BX_3$. A plasma charge is applied at the opposite side of the chamber to create a plasma comprising one or more activated boron species. The temperature at which the $KBX_4$ is heated is sufficient to release $BX_3$ therefrom. In certain embodiments, the $KBX_4$ is heated at a temperature of 700 to 900° C.

The amount of $KBX_4$ utilized in methods of the present invention is provided in an amount sufficient to maintain a pressure of about 10 to about 1500 Pascals within the reaction chamber. In certain embodiments, the pressure is from about 50 to about 1000 Pascals. In other embodiments, the pressure is from about 100 to about 750 Pascals. One of ordinary skill in the art will appreciate that the thermodecomposition of $KBX_4$ to $BX_3$ results in an increase of pressure within the reaction chamber. Without wishing to be bound by any particular theory, it is believed that the number of moles of $BX_3$ gas created may be calculated by measuring the increase of pressure.

In certain embodiments, hydrogen gas is introduced into the chamber with the $KBX_4$ and $BX_3$ resulting from the thermodecomposition thereof. Without wishing to be bound by any particular theory, it is believed that elemental hydrogen facilitates the decomposition of $BX_3$ into the one or more activated boron species upon treatment with the plasma charge. In certain embodiments, hydrogen gas is introduced in an amount that is equal to or in molar excess as compared to the amount of $BX_3$ liberated.

In some embodiments, the $BX_3$ and optional hydrogen gases are carried into a plasma by a stream of an inert gas, for example, argon. The plasma allows quicker diffusion of reactive elements and higher velocity impact of reactive boron species against the metal surface being treated. In certain embodiments, the plasma is a glow plasma. The substrate may be any material that is suitable for use with plasma treatment methods, for example, steels or titanium alloys. The $KBX_4$ may be decomposed in a separate decomposition chamber connected to the plasma chamber, or both the decomposition and the plasma treatment may occur in separate areas of a single reaction vessel.

As described herein, methods of the present invention include the step of applying a plasma charge to create one or more activated boron species. In certain embodiments, the plasma charge is a pulsed plasma charge. In other embodiments, the plasma charge is applied wherein the voltage is regulated from between about 0 to about 800 V. In still other embodiments, the amperage is about 200 A max.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

EXAMPLES

A steel part is placed into a reaction chamber along with 50 g $KBF_4$ in a boron nitride crucible. The reaction chamber is evacuated to 0.01 Pa. The crucible is heated to 900° C. resulting in decomposition of $KBF_4$ to $BF^3$. A 10% $H_2/Ar_2$ gas mixture is added to the reaction chamber to a pressure of 500 Pa. An electrical discharge is applied at 600 V and 150 Amps. The reaction is continued for about 3 hours or until desired boron penetration is accomplished.

I claim:

1. A method for boriding a metal surface, comprising:

heating $KBX_4$, wherein each X is a halogen, at a temperature sufficient to release $BX_3$;

applying a plasma charge to the $BX_3$ to create a plasma comprising one or more activated boron species; and diffusing the plasma onto the metal surface, wherein:

the $KBX_4$ is in the presence of the metal surface in a single reaction vessel such that both thermal decomposition of the $KBX_4$ and plasma treatment of the metal surface occur in separate areas of the reaction vessel; or thermal decomposition of the $KBX_4$ occurs in a separate decomposition chamber connected to a reaction vessel containing the metal surface for plasma treatment of the metal surface.

2. The method according to claim 1, wherein the metal surface is titanium or a titanium-containing metal.

3. The method according to claim 1, wherein the $KBX_4$ is heated at a temperature of 700 to 900° C.

4. The method according to claim 1, wherein the one or more activated boron are selected from $B^+$, $BX^+$, $BX_2^+$, or $BX_3^+$.

5. The method according to claim 4, wherein the plasma charge is a glow plasma.

6. The method according to claim 1, wherein the metal surface is an iron-containing metal surface.

7. The method according to claim 6, wherein the metal surface comprises a steel, an iron chromium alloy, or a titanium alloy.

8. The method according to claim 1, further comprising introducing hydrogen gas.

9. The method according to claim 8, wherein the hydrogen gas is introduced in a stream of argon.

10. A method of plasma boriding, comprising thermally decomposing $KBX_4$, wherein each X is a halogen, to produce KX and $BX_3$;

directing said $BX_3$ into a plasma formed by an inert gas, wherein the composition and plasma formation conditions are selected such that the $BX_3$ is decomposed into $BX_2^+$ and $X^-$; and allowing said $BX_2^+$ to react with a metal, wherein:

the $KBX_4$ is in the presence of the metal in a single reaction vessel such that both thermal decomposition of the $KBX_4$ and plasma treatment of the metal occur in separate areas of the reaction vessel; or thermal decomposition of the $KBX_4$ occurs in a separate decomposition chamber connected to a reaction vessel containing the metal for plasma treatment of the metal.

11. The method according to claim 10, wherein X is fluorine.

12. The method according to claim 10, wherein X is chlorine.

13. The method according to claim 10, wherein X is bromine.

14. The method according to claim 10, further introducing hydrogen gas.

15. The method according to claim 14, wherein the hydrogen gas is introduced in a stream of argon.

* * * * *